US007337725B2

(12) United States Patent
Queiroz de Aguiar

(10) Patent No.: US 7,337,725 B2
(45) Date of Patent: Mar. 4, 2008

(54) NON-LETHAL AMMUNITION PROJECTILE

(75) Inventor: Carlos Frederico Queiroz de Aguiar, Rio de Janeiro (BR)

(73) Assignee: Condor S/A Industria Quimica, Nova Iguacu, RJ (BR)

( * ) Notice: Subject to any disclaimer, the term of this patent is extended or adjusted under 35 U.S.C. 154(b) by 0 days.

(21) Appl. No.: 11/652,149

(22) Filed: Jan. 11, 2007

(65) Prior Publication Data

US 2007/0227391 A1 Oct. 4, 2007

Related U.S. Application Data

(63) Continuation of application No. 11/338,812, filed on Jan. 25, 2006, now abandoned.

(30) Foreign Application Priority Data

Jan. 26, 2005 (BR) ..... 0500226

(51) Int. Cl.
*F42B 8/12* (2006.01)

(52) U.S. Cl. ..... 102/502; 102/439

(58) Field of Classification Search ..... 102/501, 102/502, 439, 444, 529
See application file for complete search history.

(56) References Cited

U.S. PATENT DOCUMENTS

| | | | | |
|---|---|---|---|---|
| 326,231 | A | 9/1885 | Manning | 102/501 |
| 3,157,126 | A | 11/1964 | Blondeau | 102/524 |
| 3,918,364 | A | 11/1975 | Duer | 102/501 |
| 4,005,660 | A | 2/1977 | Pichard | 102/501 |
| 4,610,205 | A * | 9/1986 | Bentley | 102/529 |
| 5,086,703 | A * | 2/1992 | Klein | 102/439 |
| 5,214,237 | A | 5/1993 | McArthur | 102/501 |
| 5,686,693 | A | 11/1997 | Jakobsson | 102/501 |
| 6,041,712 | A | 3/2000 | Lyon | 102/439 |
| 6,405,654 | B1 | 6/2002 | Smith | 102/517 |
| 6,899,034 | B1 | 5/2005 | Glover et al. | 102/457 |
| 7,086,337 | B2 * | 8/2006 | Klein | 102/502 |
| 2003/0019385 | A1 * | 1/2003 | LeaSure et al. | 102/444 |
| 2006/0005730 | A1 * | 1/2006 | Mank | 102/501 |

FOREIGN PATENT DOCUMENTS

| | | | |
|---|---|---|---|
| FR | 2639104 | A * | 5/1990 |
| FR | 2703445 | A1 * | 10/1994 |

* cited by examiner

*Primary Examiner*—James S Bergin
(74) *Attorney, Agent, or Firm*—Finnegan, Henderson, Farabow, Garrett & Dunner, L.L.P.

(57) ABSTRACT

The present invention relates to a projectile (1) for non-lethal ammunition of a body that is composed of a first portion (2) and a second portion (4). Said first portion (2) has a larger mass that the second portion (4), so as to increase the stability of the projectile (1). In addition, the projectile (1) has a strangulation (5) that connects the first portion (2) to the second portion, wherein the first portion (2) is formed by two rings (3), and the two rings (3) are interconnected by an annular groove (6), and wherein the end opposite the strangulation (50 of the second portion (4) has an annular base (7).

17 Claims, 13 Drawing Sheets

NON-LETHAL AMMUNITION PROJECTILE

RELATED APPLICATIONS

This application is a continuation of application Ser. No. 11/338,812, filed Jan. 25, 2006, now abandoned and claims priority of Brazilian application No. P10500226-5, filed Jan. 26, 2005.

The present invention relates to a projectile for non-lethal ammunition, used in a fire arm.

DESCRIPTION OF THE PRIOR ART

Non-lethal arms are designed and employed to incapacitate people and material temporarily, without causing deaths, permanent injuries or even undesirable material damages to buildings and to the environment. Thus, they enable one to employ gradual force, reducing the situations in which the use of lethal arms is determinant.

Non-lethal arms further have a broad application in the public-security area, especially in controlling disturbances of all kinds, including in the case of rebellions in the prison system.

As non-lethal arms, one can exemplify truncheon, chemical-product sprayers, electric-shock devices, miscellaneous-effects grenades and non-lethal ammunition launchers, among which rubber bullets.

Rubber bullets are usually inserted into cartridges, the basic function of which is similar to that of an ordinary cartridge. Its action, however, when they are shot against a person, aims at incapacitating him temporarily without causing death or permanent damage.

The above-mentioned type of ammunition—non-lethal—may be a cartridge comprising a plurality of rubber spheres, as is the case of the Model 3020 Stinger-HV cartridge from Armor Holdings, which has 18 spheres, shown in FIG. 1. This type of ammunition has the same functioning principles of a conventional lethal ammunition. Such conventional lethal ammunition comprises a priming cap A, which ignites a projection charge B that accounts for driving the projectile (s) C. Naturally, the possibility of one of the projectiles hitting the target is greater than if a single rubber sphere were used. However, with this increase in the possibility of hitting the target, the accuracy of the shooter decreases considerably, since the dispersion of the projectiles along the path renders it difficult to determine the impacts points.

Another type of non-lethal ammunition employs a smaller amount of projectiles, such as AM-403/A or AM-403C from Condor Tecnologias Não-Letais, which have 3 projectiles (see FIGS. 2 and 3). These ammunitions have the same functioning principle of the ammunition mentioned before, but these ammunitions have 3 cylinders or spheres D inserted in one cartridge E, which are the projectiles of this ammunition. These projectiles, made from rubber, are sequentially arranged within the cartridge E and do not have a satisfactory accuracy, as the earlier projectiles did.

In addition, in order for the non-lethal projectiles not to perforate or cause lethality, the shooting should be effected at a minimum safety distance, so that the projectile will slow down sufficiently before hitting the target. The longer the distance, the greater the need to use ammunitions that bring about precision shooting.

Since the ammunitions mentioned so far, provided with a plurality of projectiles, are characterized by their low accuracy, when one desires greater precision, one uses ammunitions with controlled impact, containing a single projectile in the cartridge.

At present, there are three main types of controlled-impact non-lethal ammunitions, which are known by those skilled in the art, namely: single projectile, "bean-bag" and winged projectile. The single projectile type is similar to those mentioned before, but instead of having a plurality of projectiles, it has only one cylindrical projectile. This type of projectile is shown in FIG. 4, which discloses an ammunition F with a single cylindrical projectile G. When this projectile comes out of the firearm it has greater accuracy that those with a larger number of projectiles, since its stability can be maximized while it runs through the barrel. However, although the accuracy is higher, the flight of this projectile is still not stable. So, the shooter is liable to hit undesired points at the target person or simply miss the desired target, even if he has used the triggering equipment correctly.

Another type of single projectile, known as "bean-bag", consists of a bag sewn at the edges and filled up with some material allowing the bag to be folded within a cartridge, as can be seen in FIG. 5. After the triggering, the "bean-bag" passes through the barrel and, upon coming out of it, opens up due to pressures that the air exerts on this "bean-bag". Since the shape and the position of the bean-bag may be little determined during its flight, its path is easily modified because the lack of aerodynamics of such "bean-bag". Moreover, the material used for filling up the bean-bag is often composed of small lead spheres prone to polluting the environment and that may be lethal, in case the bag in which they are contained breaks open.

In view of the fact that the flight of the bean-bag is imprecise, a flight-stability device J has been developed, which can be seen in FIG. 6. This flight-stability device J is a kind of tail fixed to the "bean-bag" so that this tail will create a drag at a back portion of the bean-bag and thus impart greater stability to the flight of this projectile. An example of a bean-bag provided with the flight-stability device J, for stability after triggering an arm with this type of ammunition, is shown in FIG. 7. However, even with the flight-stability device J, the accuracy of this projectile is not satisfactory so as to provide sufficient safety for the use of the non-lethal ammunition.

The ammunition of the type of a projectile having rubber wings has the shape shown in FIG. 8. This shape theoretically ensures a relatively foreseeable flight of the projectile, since at the back portion of the projectile there are flaps L that impart greater stability to it. However, since it is essential for this type of ammunition to be made of a soft material, in order to guarantee its non-lethality, the high pressures which the projectile undergoes during its flight cause deformations on these flaps and impair the foreseeability of the projectile path, causing the accuracy not to be satisfactory for the required safety standards.

BRIEF DESCRIPTION OF THE INVENTION

An objective of the present invention is to provide a projectile for non-lethal ammunition having a safe accuracy. The projectile is a body having a front portion and a rear portion, which have different masses to increase the precision of the weapon that uses the present projectile. Between these portions, there is a reduced diameter section that unites them, the front portion being composed of a plurality of rings connected by annular grooves, as well as an annular stabilizing base at an end opposite the front portion, which increases the flight stability of the projectile.

BRIEF DESCRIPTION OF THE DRAWINGS

The present invention will now be described in greater detail with reference to an embodiment represented on the drawings.

FIG. 2 is a cross-sectional view of a non-lethal ammunition of the prior at;

DETAILED DESCRIPTION OF THE FIGURES

Figure 1:
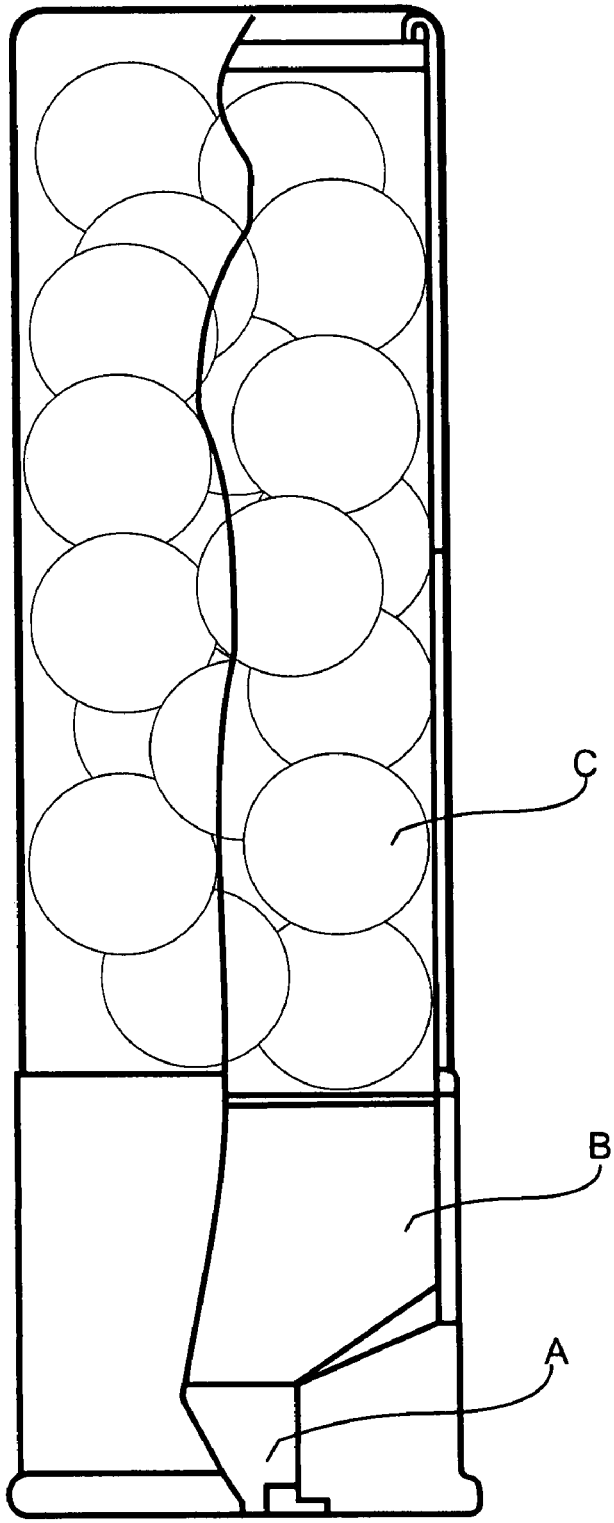
FIG 1 PRIOR ART
FIG. 1 is a cross-sectional view of a non-lethal ammunition of the prior art.
Figure 2:
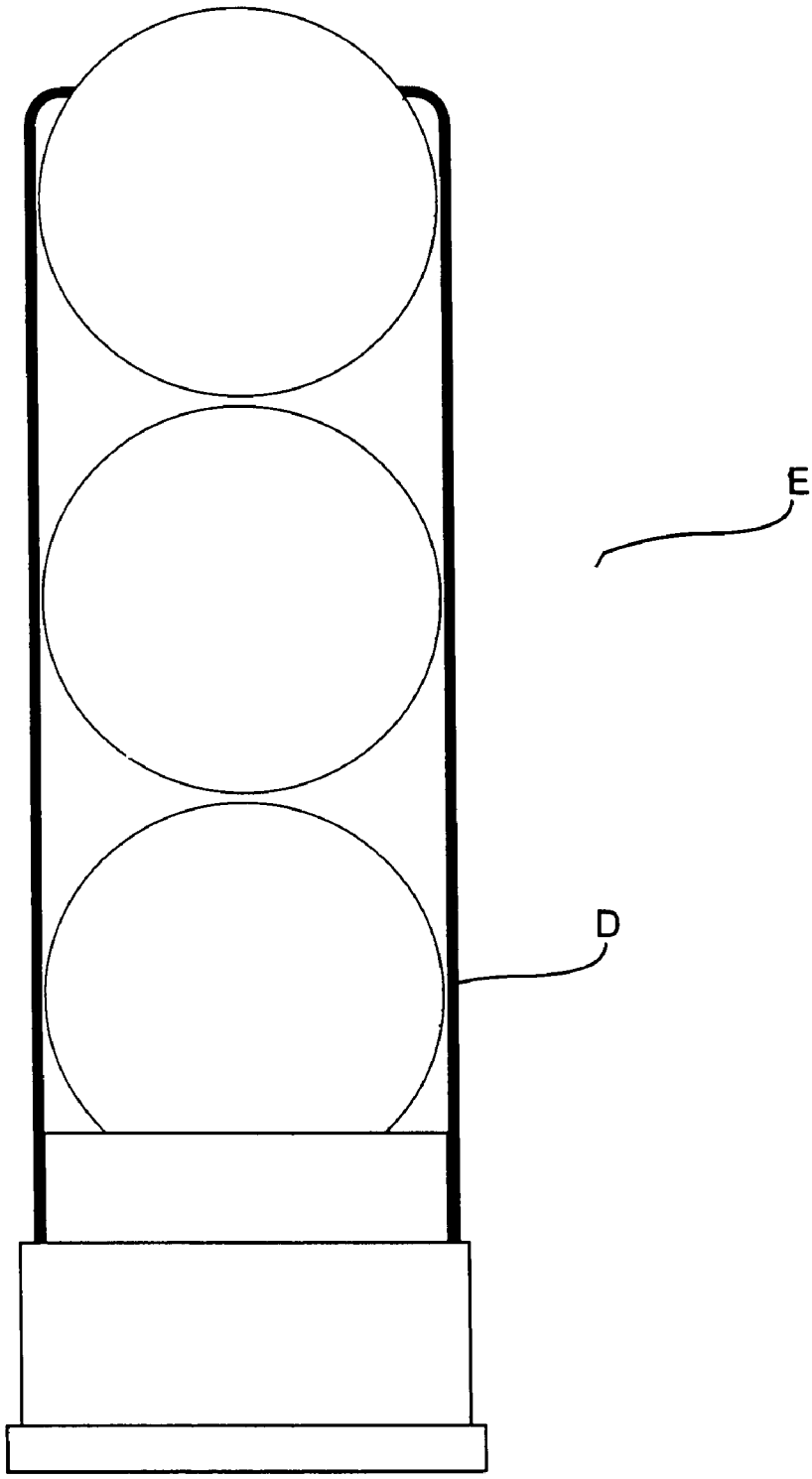
FIG 2 PRIOR ART
Figure 3:
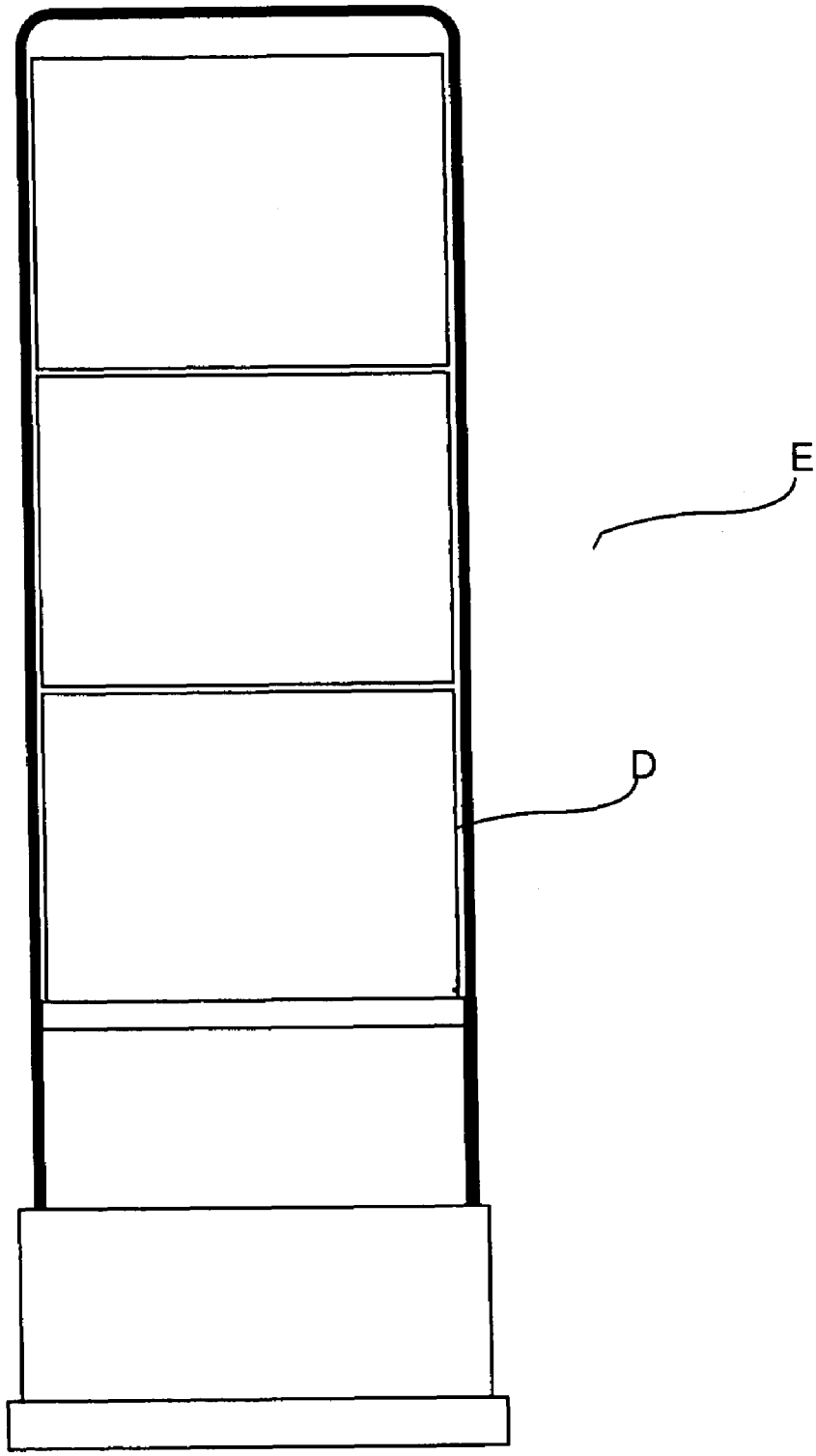
FIG 3 PRIOR ART
FIG. 3 is a cross-sectional view of a non-lethal ammunition of the prior art.
Figure 4:
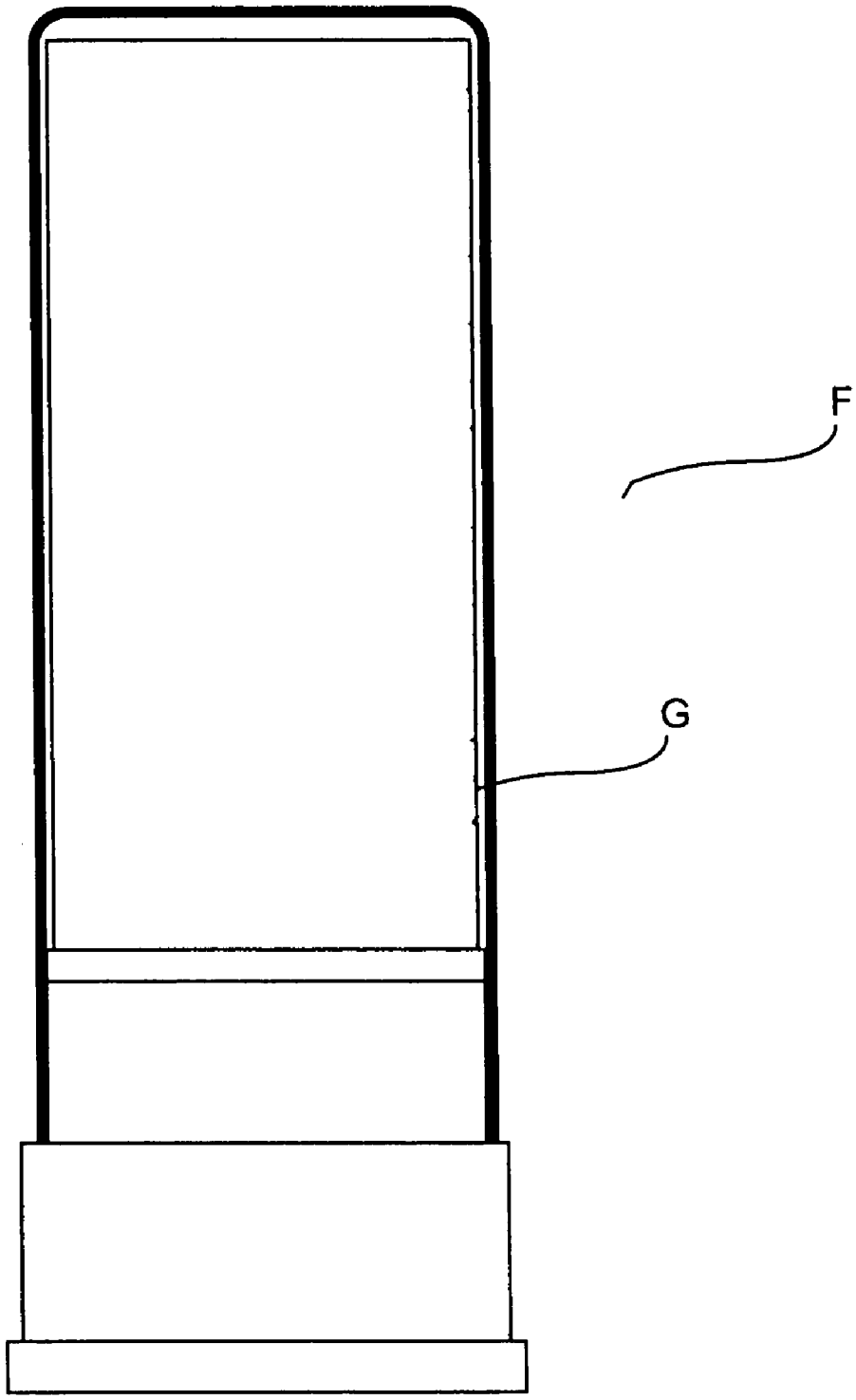
FIG 4 PRIOR ART
FIG. 4 is a cross-sectional view of a non-lethal ammunition of the prior art.
Figure 5:
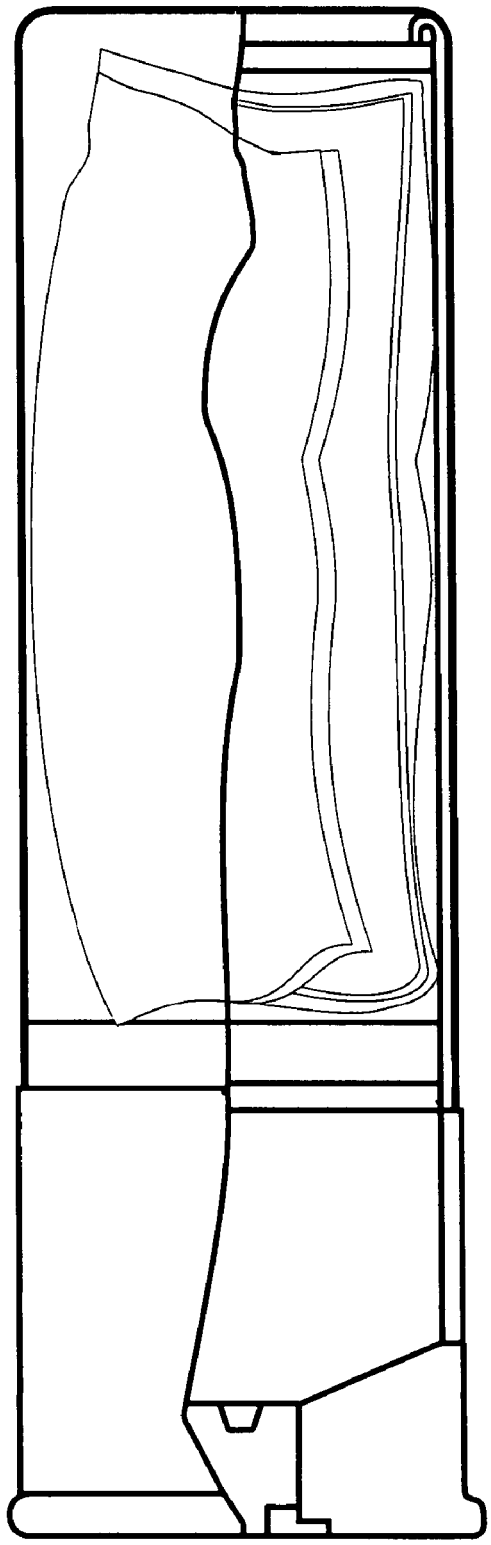
FIG 5 PRIOR ART
FIG. 5 is a cross-sectional view of a non-lethal ammunition of the prior art.
Figure 6:
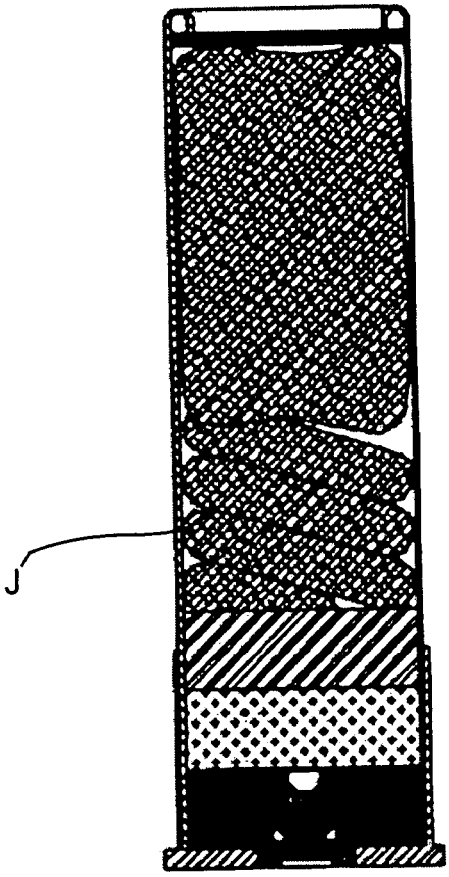
FIG 6 PRIOR ART
FIG. 6 is a cross-sectional view of a non-lethal ammunition of the prior art.
Figure 7:
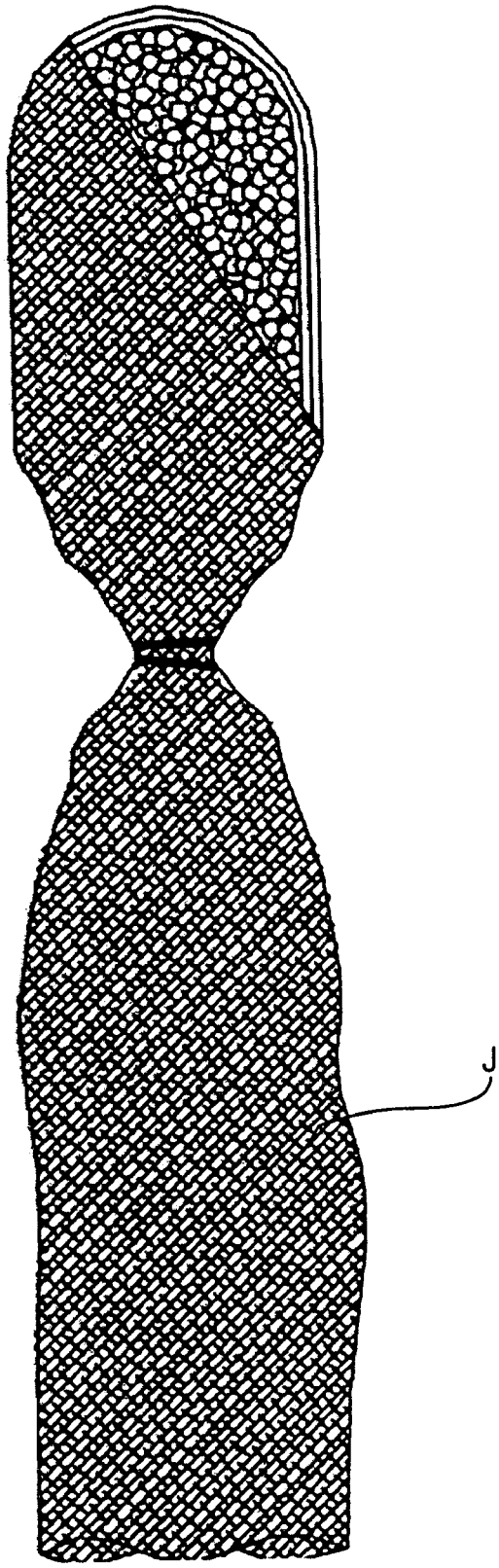
FIG 7 PRIOR ART
FIG. 7 is a cross-sectional view of a projectile for non-lethal ammunition of the prior art.
Figure 8:
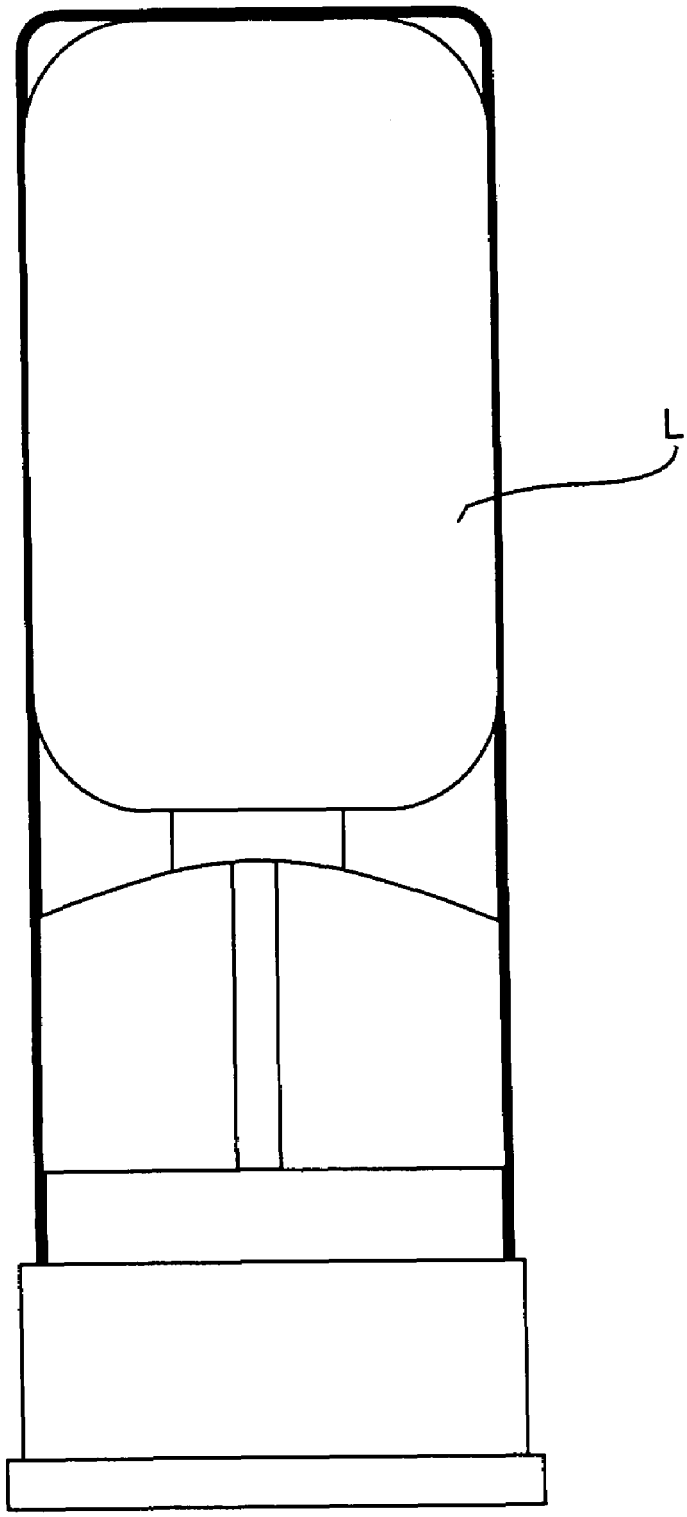
FIG 8 PRIOR ART
FIG. 8 is a cross-sectional view of a non-lethal ammunition of the prior art.
Figure 9:
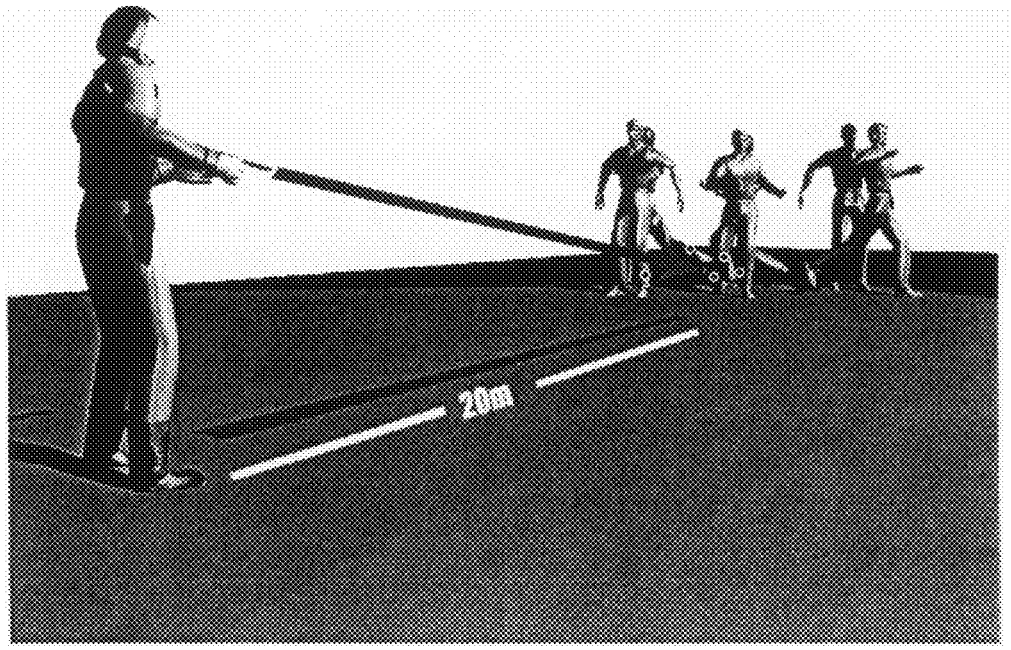
FIG. 9 shows a demonstration of the use of a non-lethal ammunition.

As can be seen in FIG. 9, weapons provided with a non-lethal ammunition may be used against people. The figure shows a demonstration of the use of the present invention. A shooter armed with a firearm shoots from a minimum distance of 20 meters at people. This distance varies according to the recommendations of each manufacturer of the non-lethal ammunition, and should be sufficient for the non-lethal projectile to decelerate sufficiently, so that, upon hitting the person, its effect will not be lethal or does not cause permanent traumas on the target person. Shorter distances may be used for emergency cases.

The shooter shown in FIG. 9 makes adequate use of the weapon, since he aims regions, in this case the legs, of the target person where the possibility of causing a permanent trauma is completely eliminated.

Thus, the main objective of the present invention is to increase the accuracy of non-lethal projects, since it guarantees sufficient precision for the shooter to hit the desired target at adequate shooting distances against target people. The desired target may be not only a person, but also an object; for instance, if the shooter desires to hit the arm held by an aggressor without impairing the safety of third people around. Since it is highly desirable to increase the precision of the non-lethal ammunitions, the projectile of the present invention meets the present demand for precision in triggering arms with the objective of non-lethality.

Figure 10:
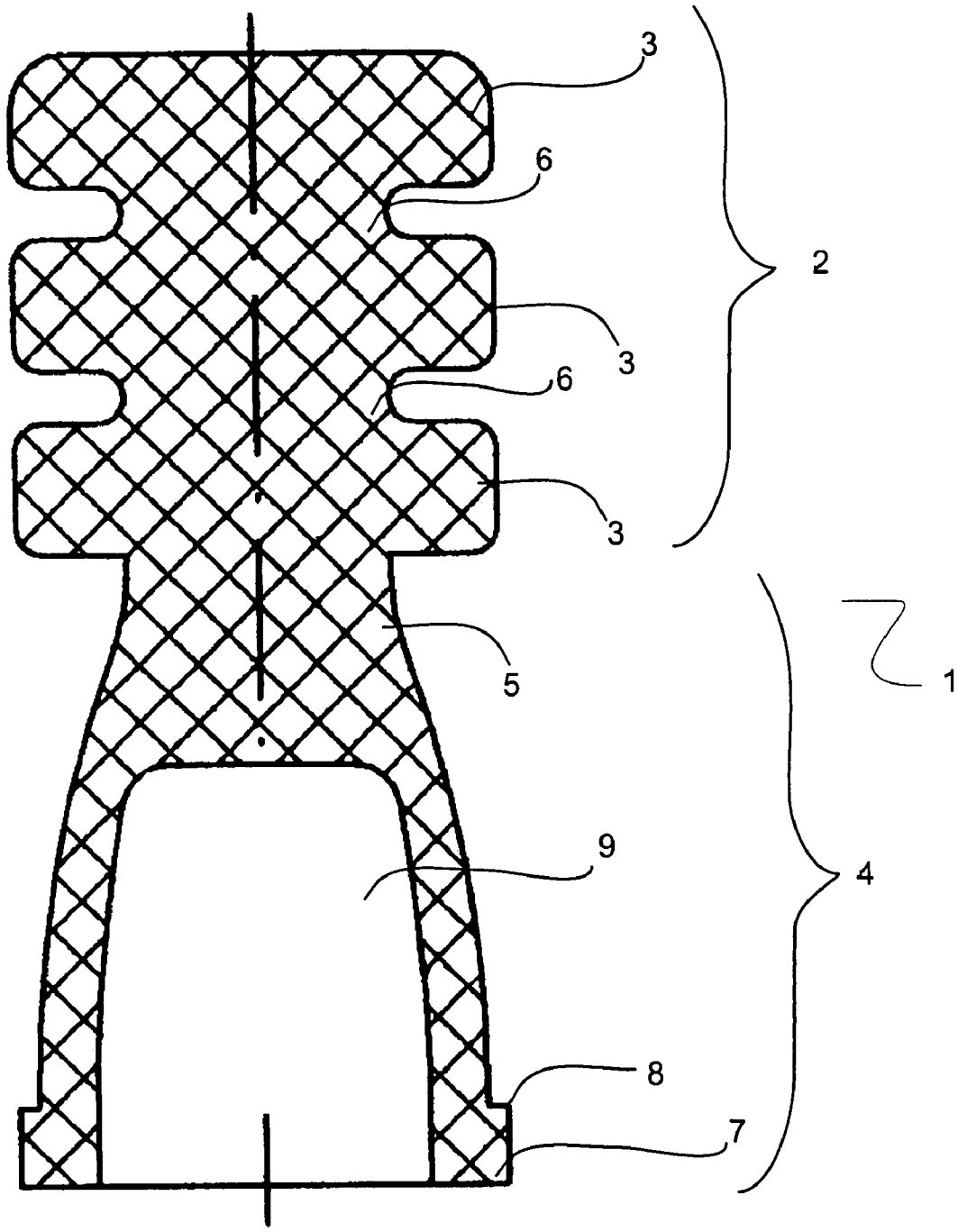
FIG. 10 is a cross-sectional view of the projectile for the non-lethal ammunition of the present invention.

FIG. 10 shows a cross-sectional view of a projectile 1 for a non-lethal ammunition, composed of a front portion 2, which comprises three coaxial and equidistant rings 3. The rings 3 are spaced apart by two annular grooves 6, arranged between the rings 3, which in reality are a reduction of the diameter in the intersection of the rings 3. The form between the rings 3 and the annular grooves 6 are essential for absorbing kinetic energy during the impact of the projectile 1 against the target, since some of the kinetic energy is lost in the form of deformation work, because upon the impact with the target the rings are compressed against themselves so as to act as a damper during the impact. Further, the annular grooves 6 aid in deforming the front portion 2.

Besides absorbing kinetic energy, the front portion 2 is also used for aiding in the stabilization of the projectile during its flight, since the front portion 2 has the biggest part of the mass of the projectile 1. Bearing in mind this mass distribution, the mass center is located closer to one of the ends of the projectile 1, which in the present embodiment of the invention, is on the front portion 2. Such a distribution of mass makes the mass center of the projectile 1 as front as possible (with respect to the path direction) to the aerodynamic center of the projectile 1, thus increasing the stabilizing moment. The fact of increasing the stabilizing moment of the projectile 1, in conjunction with other characteristics of the projectile 1, which will be explained later, makes the flight stable, so that the required accuracy is achieved.

In order to prove the efficacy of the absorption of kinetic energy of the projectile with a significant mass amount in the front portion 2, ballistic tests were carried out, which consisted in firing a firearm several times that was calibrated and loaded with ammunition containing the projectile 1. These tests were made at a distance of 20 (twenty) meters from the target. The target was a test body made from plastiline and, after the shooting, the deformation undergone by the plasiline body is measured, and one admits a maximum deformation of 44 (forty-four) mm, equivalent to the maximum deformation admitted for the case of a shot against the bulletproof vest put over the plastiline, according to the NIJ Standard rule 0101.03. These ballistic tests, achieved an average deformation of only 33 (thirty-three) mm. In this way it is proved that the present projectile, besides obtaining greater accuracy, is also safer and supports the use of non-lethal ammunition to guarantee the preservation of life.

Further in FIGS. 10 one can see a rear portion 4, which includes a "skirt" of the projectile 1. This rear portion 4 is connected to the front portion 2 by means of a reduced diameter section 5, which has a diameter smaller than that of the rings 3. From the reduced diameter section 5 towards the front portion 2, the diameter of the rear portion 4 increases gradually until it reaches the shoulder 8. From this shoulder 8, an annular stabilizing base 7 extends, which has a diameter slightly larger than the diameter of the rings 3. Moreover, an internal region 9 of the rear portion 4 is hollow, so as to reduce the mass of the rear portion 4 and not to impair the position of the mass center, which influences the behavior of the projectile 1 greatly during its flight.

The above-described shape of the rear portion 4 is essential for the stabilization of the projectile 1 during its flight and in the gun barrel, where the pressures are high. As disclosed above, the annular base 7 has a larger diameter than any other part of the projectile 1. In this way, when the ammunition is fired, the annular base comes in frictional contact with the bore, thus effecting the initial deceleration of the projectile, and further, with this frictional contact, a stabilization of the projectile within the barrel takes place, which renders the projectile 1 stable while it is coming out and starting a stable flight until the target is hit.

Moreover, it has been verified that the most suitable material for the manufacture of the projectile 1 is rubber. In this case, the projectile is made by rubber injection. However, it should be pointed out that other material may be employed for making it. And further, since this manufacture is effected by injection, all of the components of the projectile 1 described above constitute a single piece.

Figure 11:
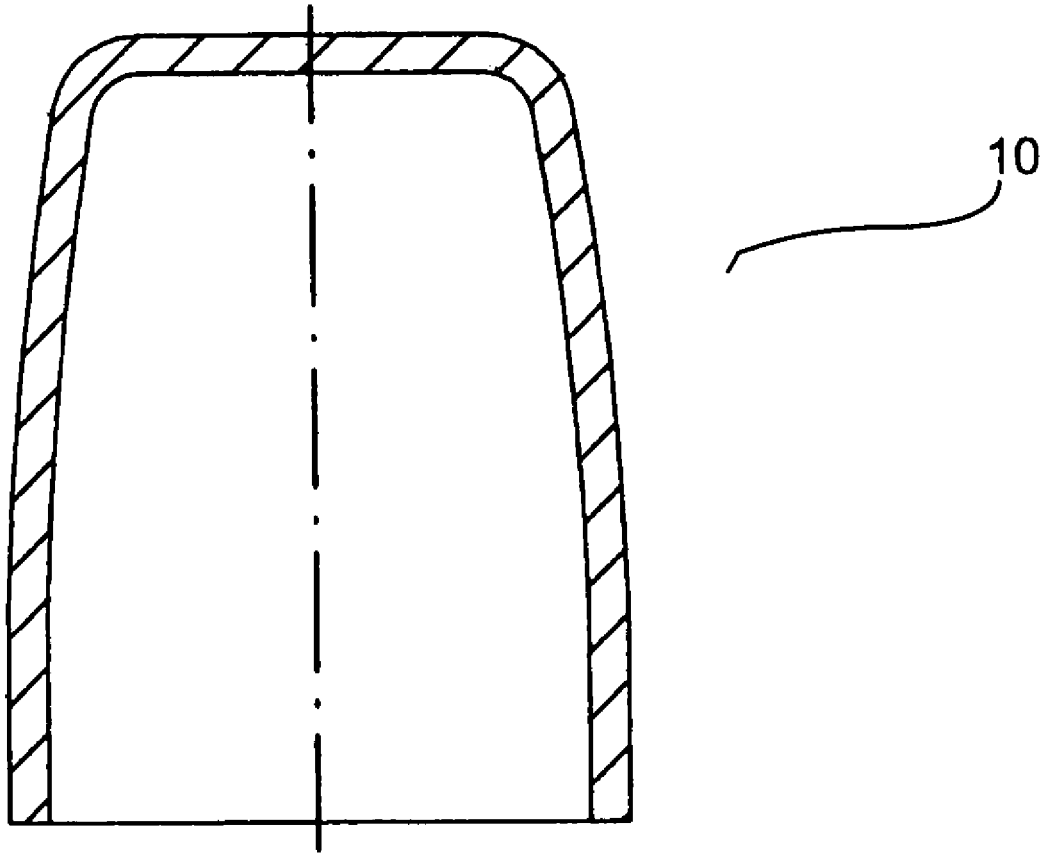
FIG. 11 is a cross-sectional view of a reinforcement core of the projectile for a non-lethal ammunition shown in FIG. 10.

In spite of the increase obtained in accuracy of the projectile 1 described above, one has also made an improvement in the second portion 4, namely the introduction of a reinforcement core 10 within the region 9. This reinforcement core 10 can be seen in FIG. 11, which is an internal reinforcement of the rear portion 4, so as to impart more mechanical strength. The thickness of the wall of the reinforcement core 10 is as small as possible in order not to increase the mass of the rear portion 4 too much, so that it will not influence the mass center of the projectile 1 and the external shape of the reinforcement core 10 fits into the internal shape of the rear portion 4, that is, of the region 9.

Normally the material used for the reinforcement core 10 is plastic, but one should understand that the reinforcement core 10 is made of a material that simply increases the mechanical strength of the rear portion 4, and there is the possibility of applying other treatments and devices for obtaining the desired strength.

The achievement of the above-mentioned strength is due to the fact that, during the expansion of the gases from the gunpowder combustion of the ammunition, the rear portion 4 undergoes high pressures and change the strength.

The achievement of the above-mentioned strength is due to the fact that, during the expansion of the gases from the gunpowder combustion of the ammunition, the rear portion 4 undergoes high pressures and change the desired shape of this part. If the shape changes significantly within the barrel or even during the flight of the projectile, the stability is strongly impaired, for which reason the above-mentioned reinforcement has been introduced.

Figure 12:
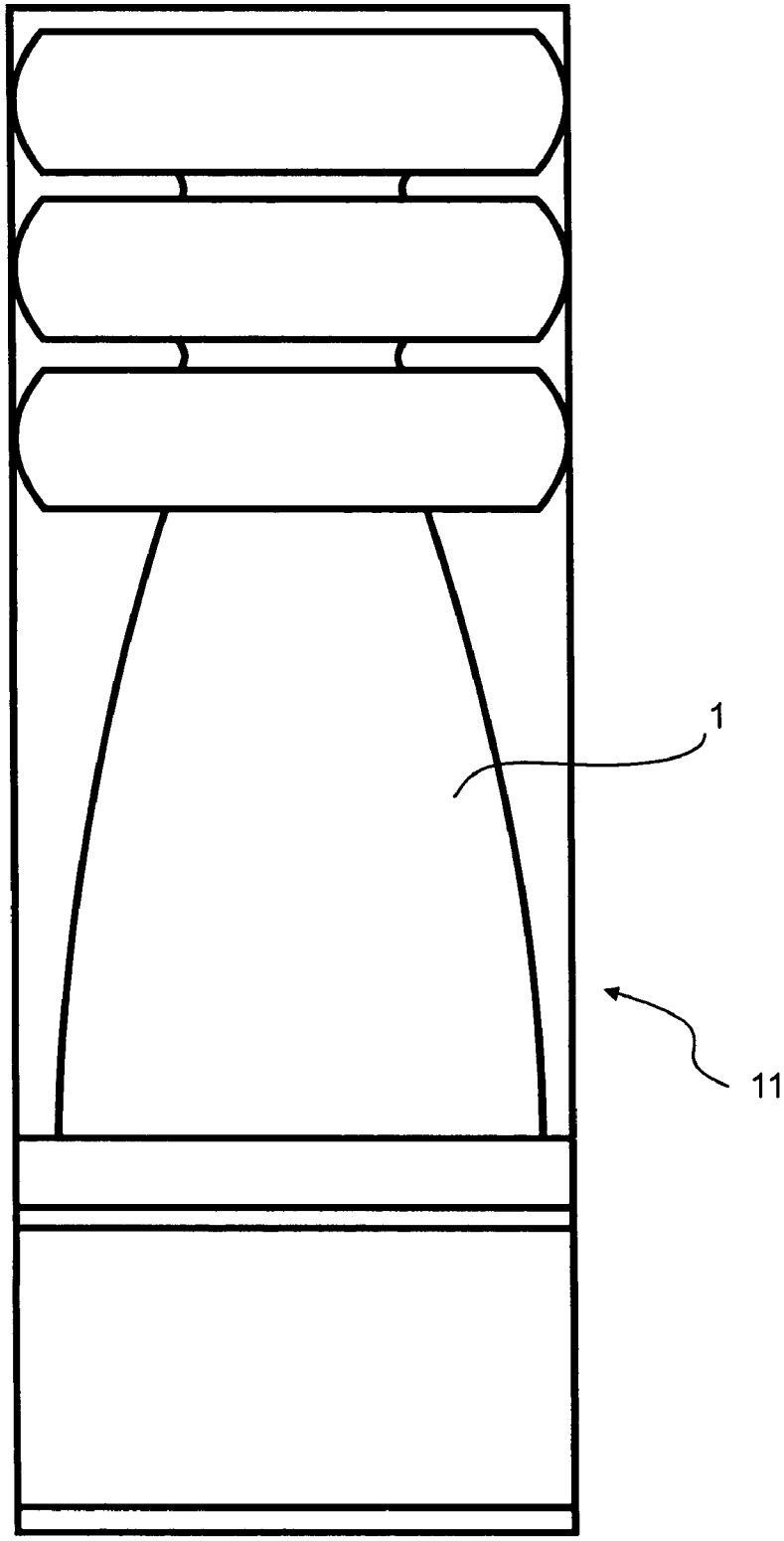
FIG. 12 is a cross-sectional view of a non-lethal ammunition of the non-lethal projectile shown in FIG. 10.

In FIG. 12 one can se the arrangement of the projectile 1 inside the cartridge 11. It must be noted that the projectile 1 is totally inserted into the cartridge 11, but the projectile 1 may be used in different types of ammunition. The cartridge has an opening 12 where the projectile 1 exits the cartridge 11 when it is shot. On the opposite end of the cartridge 11 with regard to the opening 12 there is a bottom extremity 13 that does not allow the passage of the projectile 1. Thus, there is a proper orientation of the projectile 1 in the cartridge 11. This determines the correct orientation and trajectory of the projectile.

Figure 13:
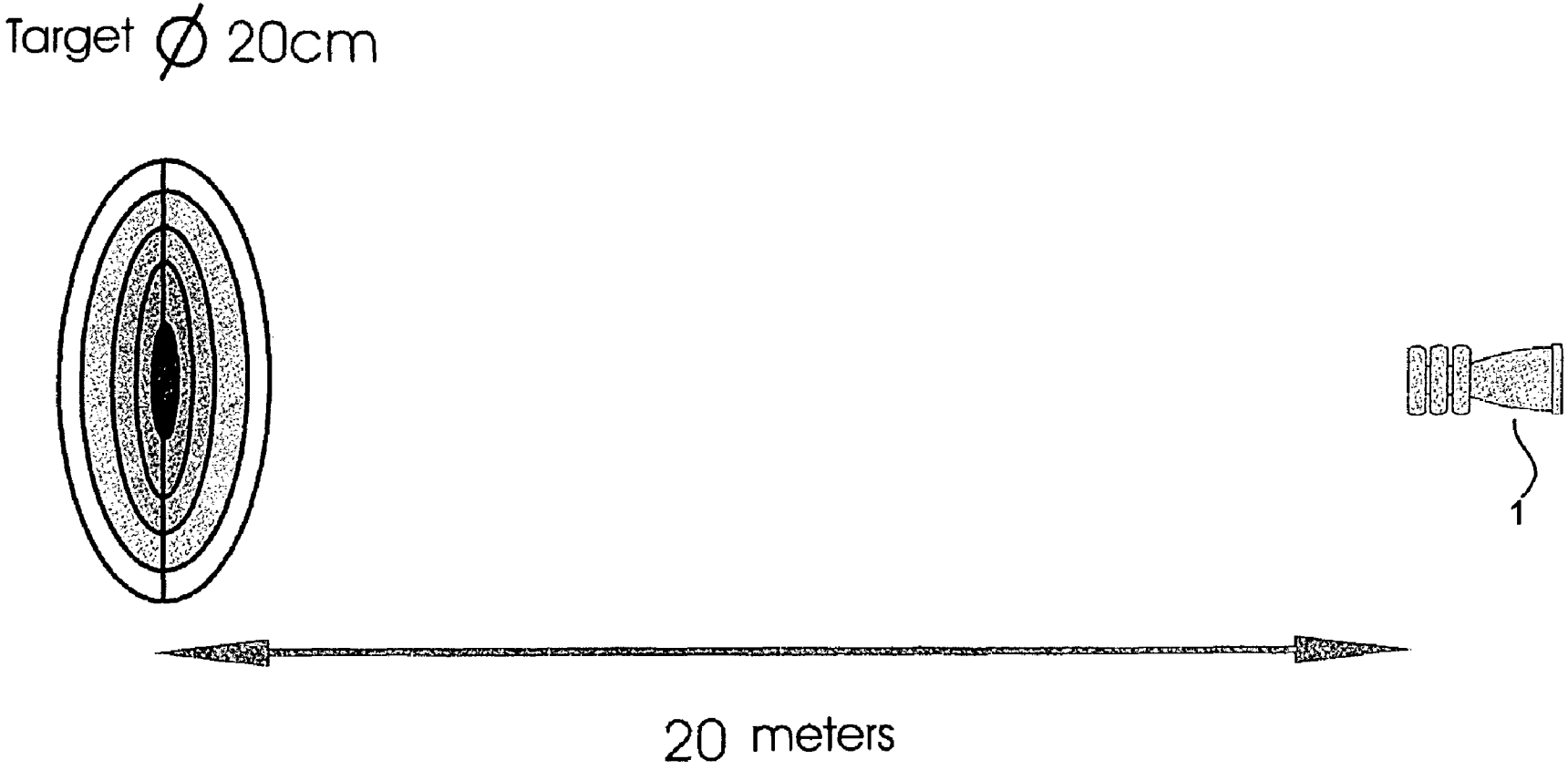
FIG. 13 is an illustration of the accuracy achieved by the non-lethal ammunition provided with the non-lethal projectile shown in FIG. 10.
Figure 14:
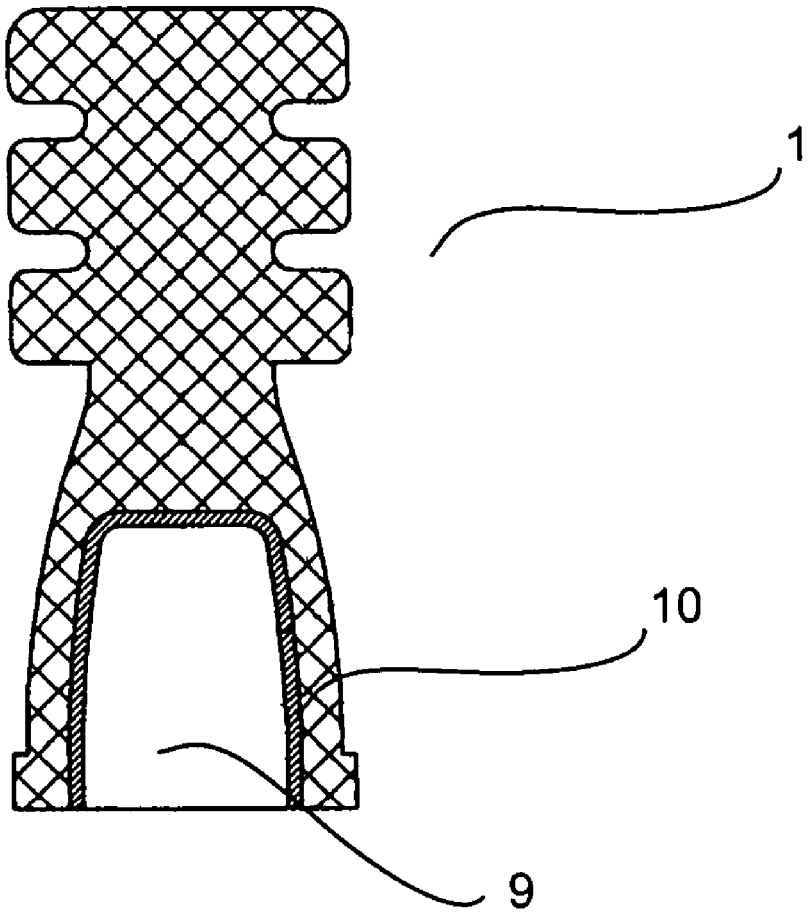
FIG. 14 is a cross-sectional view of the projectile for the non-lethal ammunition, wherein a reinforcement core is included within the projectile.

In addition to this embodiment, one can observe in the demonstration of ballistic tests of FIG. 13, that when the projectile is fired from a 20-meter distance at a standard target having a 20-centimeter diameter all the projectiles of the present invention hit the target. This demonstrates that the present projectile 1 indeed exhibits accuracy much superior to that of the prior-art projectiles.

A preferred embodiment having been described, one should understand that the scope of the present invention embraces other possible variations, being limited only by the contents of the accompanying claims, which include the possible equivalents.

What is claimed is:

1. A projectile for non-lethal ammunition consisting essentially of a non-metallic, plastically deformable material, the projectile comprising:

a body having a first forward portion and a second rearward portion, wherein the first portion has a larger mass than the second portion;

a reduced diameter connection between the first portion and the second portion;

wherein the first portion includes a plurality of circumferential rings, separated by at least one circumferential groove, and wherein the end of the second portion opposite the reduced diameter connection has an annular base forming a rear-ward facing opening.

2. A projectile according to claim 1, wherein the first portion includes three rings.

3. A projectile according to claim 2, wherein the rings have the same diameter.

4. A projectile according to claim 1, wherein the lower portion includes an insert within the rearward facing opening, the insert being comprised of a material different of that of the projectile.

5. A projectile according to claim 4, wherein the insert is comprised of plastic.

6. A projectile according to claim 1, wherein the projectile is comprised of rubber.

7. A projectile according to claim 1, wherein the annular base has a diameter larger than the connection.

8. A projectile according to claim 1, wherein the rings have the same diameter.

9. A projectile according to claim 1, wherein the second portion is partly hollow.

10. A projectile according to claim 1, wherein the outside diameter of the base has the same diameter as the rings.

11. A projectile according to claim 1, wherein the outside diameter of the base has a circumferential ring the same diameter as the circumferential rings in the forward portion.

12. A projectile according to claim 1, wherein the center of mass of the projectile is in the forward portion.

13. A projectile according to claim 1, wherein the forward portion is substantially cylindrical.

14. A projectile according to claim 1, wherein the circumferential rings and grooves in the forward portion are disposed to absorb energy.

15. A projectile according to claim 1, wherein the forward portion includes a substantially flat forward end opposite the reduced diameter connection.

16. A projectile according to claim 15, wherein the substantially flat forward end opposite the reduced diameter connection and the circumferential rings and grooves in the forward portion are disposed to absorb energy in an amount sufficient to prevent lethal trauma to a living target.

17. A projectile according to claim 1, the combination of the properties of the plastically deformable material and the rings and at least one groove being disposed to absorb energy in an amount sufficient to prevent lethal trauma to a living target.

* * * * *